US012540611B2

(12) United States Patent
Zhang

(10) Patent No.: US 12,540,611 B2
(45) Date of Patent: Feb. 3, 2026

(54) BEAM PUMPING UNIT AND DESIGN METHOD FOR BEAM PUMPING UNIT

(71) Applicant: APEX OILFIELD EQUIPMENT (QINGDAO) CO., LTD, Qingdao (CN)

(72) Inventor: Cong Zhang, Qingdao (CN)

(73) Assignee: APEX OILFIELD EQUIPMENT (QINGDAO) CO., LTD, Qingdao (CN)

( * ) Notice: Subject to any disclaimer, the term of this patent is extended or adjusted under 35 U.S.C. 154(b) by 116 days.

(21) Appl. No.: 18/230,684

(22) Filed: Aug. 7, 2023

(65) Prior Publication Data

US 2023/0383739 A1 Nov. 30, 2023

Related U.S. Application Data

(63) Continuation of application No. PCT/CN2022/082965, filed on Mar. 25, 2022.

(30) Foreign Application Priority Data

Jan. 29, 2022 (CN) ..... 202220241913.2

(51) Int. Cl.
*F04B 47/02* (2006.01)

(52) U.S. Cl.
CPC ..... *F04B 47/028* (2013.01)

(58) Field of Classification Search
CPC ..... F04B 27/026; F04B 27/022; F04B 27/028
See application file for complete search history.

(56) References Cited

U.S. PATENT DOCUMENTS 10,107,282 B1 10/2018 Dreher

FOREIGN PATENT DOCUMENTS

| | | | | |
|---|---|---|---|---|
| CN | 2428598 | Y | * | 5/2001 |
| CN | 101424928 | A | | 5/2009 |
| CN | 104595255 | A | | 5/2015 |
| CN | 110566163 | A | * | 12/2019 |

(Continued)

OTHER PUBLICATIONS

Zhang Jianjun et al., Optimized Design of Mechanism Dimensions of Swimming Beam Oil Pumping Machine, Calculation of the design of traveler beam pumping machine, 2005, pp. 56-59, Petroleum Industry Press.

(Continued)

*Primary Examiner* — Gregory Robert Weber
(74) *Attorney, Agent, or Firm* — Bayramoglu Law Offices

(57) ABSTRACT

A beam pumping unit includes a bracket; a walking beam arranged above the bracket, wherein a middle part of the walking beam forms a first pivotal connection having a first pivotal center with the bracket, a donkey head is mounted on a front side of the first pivotal center, and a walking beam tail seat is mounted on a rear side of the first pivotal center; a rotating arm arranged behind and below the first pivotal center and having a first position formed as a rotating center and a second position rotating around the rotating center by a radius R; and a drive rod, wherein a lower part of the drive rod forms a second pivotal connection having a second pivotal center with the second position, and an upper part of the drive rod forms a third pivotal connection having a third pivotal center with the walking beam.

9 Claims, 4 Drawing Sheets

(56) References Cited

FOREIGN PATENT DOCUMENTS

| | | | |
|---|---|---|---|
| CN | 110608014 | A | 12/2019 |
| CN | 210948602 | U | 7/2020 |
| CN | 211008582 | U | 7/2020 |
| CN | 112502672 | A | 3/2021 |

OTHER PUBLICATIONS

Specification for Pumping Units, API Specification 11 E 19th Edition, 2013, pp. 1-103.

* cited by examiner

BEAM PUMPING UNIT AND DESIGN METHOD FOR BEAM PUMPING UNIT

CROSS REFERENCE TO THE RELATED APPLICATIONS

This application is a continuation application of International Application No. PCT/CN2022/082965, filed on Mar. 25, 2022, which is based upon and claims priority to Chinese Patent Application No. 202220241913.2, filed on Jan. 29, 2022, the entire contents of which are incorporated herein by reference.

TECHNICAL FIELD

The present disclosure relates to the field of petroleum technologies, in particular to a beam pumping unit and a design method for the beam pumping unit.

BACKGROUND

At present, with the continuous development, stratum energies are gradually consumed for most oil fields in the world; oil wells exhibit the phenomena that oil layers are descended, and the liquidity becomes poorer; and depths of newly developed oil wells are increased, which have different requirements for the oil production technology. At this time, it is more reasonable to employ a pumping solution with adding a stroke.

An existing long-stroke pumping unit mainly focuses on a beam-free pumping unit. However, discovered from actual application, the beam-free pumping unit is complex in structure and more in moving parts and electric appliance control elements; and the beam-free pumping unit is inferior to the beam pumping unit in the aspects of maintenance cost, durability and reliability. In contrast, a beam pumping unit based on a four-connecting-rod mechanism is simple in structure, high in reliability and smooth in swinging reversing of a donkey head and is a most widely applied pumping unit structure.

In the prior art, the beam pumping unit can achieve a stroke of 300 feet or below only; if the stroke approaches 300 feet, the beam pumping unit is a so-called long stroke beam pumping unit. However, there is no involvement of the beam pumping unit with the stroke of 300 feet or above, i.e. 7,620 mm or above, the main reason for which is that based on a traditional design method, if the above super-long stroke is achieved on the beam pumping unit, the structure would be very heavy, a size and a weight cannot be controlled, and thus construction and transportation are affected.

SUMMARY

The present disclosure is proposed based on the above demands in the prior art and aims at solving the technical problem of providing a super-long stroke pumping unit, particularly a beam pumping unit with a super-long stroke, so as to achieve a stroke of 7,620 mm or above on a practical beam pumping unit product.

To solve the above problem, the technical solution of the present disclosure is as follows:

a beam pumping unit is provided, comprising a bracket; a walking beam arranged above the bracket, wherein the middle part of the walking beam forms a first pivotal connection having a first pivotal center with the bracket, a first end and a second end distributed on the front side and the rear side of the first pivotal center respectively are formed, a donkey head is mounted at the first end, a walking beam tail seat is mounted at the second end, and a distance from a donkey head suspension point to the first pivotal center is A; a rotating arm arranged behind and below the first pivotal center and having a first position formed as a rotating center and a second position rotating around the rotating center by a radius R; and a drive rod, wherein the lower part of the drive rod forms a second pivotal connection having a second pivotal center with the second position, and the upper part of the drive rod forms a third pivotal connection having a third pivotal center with the walking beam tail seat. A straight-line distance between the third pivotal center and the first pivotal center is C; the second pivotal center makes a circular motion around the rotating center at a rotating angle θ to drive the walking beam to swing at a preset magnitude of angle δ, and then the donkey head is driven to conduct up-down reciprocating motion; the third pivotal center is set higher than the rotating center; a stroke of the pumping unit is above 7,620 mm; and $58° < \delta \leq 72°$.

Through the above technical solution, the technical prejudices that the beam pumping unit cannot break through the stroke exceeding 7,620 mm and a swinging angle of the walking beam requires to be 58° or below in the prior art are overcome. By setting a large-swinging-angle walking beam with a swinging angle of the walking beam as $58° < \delta \leq 72°$, a longer motion distance may be provided at the tail end of the walking beam, and therefore, convenience is provided for achieving a long stroke. Also, under the condition of implementing the above super-long stroke beam pumping unit, the volume of the beam pumping unit cannot be increased significantly to result in the defect in applicability, so that the technical prejudices can be overcome, and the unexpected technical effects can further be achieved.

Preferably, the third pivotal center and the first pivotal center define a first straight line; the walking beam defines a second straight line; and an angle γ is formed between the first straight line and the second straight line, and $3° \leq \gamma < 15°$.

As the pumping unit of the present disclosure has a super-long stroke, through the design of the angle γ, the walking beam may drive the donkey head to swing up and down relative to a plane comprising a pivotal center; and the walking beam and the donkey head are smaller in swinging distance in a space above the plane and larger in swinging distance in a space below the plane. Therefore, during working, the beam pumping unit may keep a low gravity center, and then balance and the stability of the whole pumping unit are kept.

Preferably, $2 < A/C \leq 2.5$.

In the design of the pumping unit of the present disclosure, in a case of a certain stroke S, A and the angle δ require to be adjusted to meet the stroke S. At this time, by employing a larger angle δ, a value of A, the size of the walking beam and a rotational inertia may be all reduced; and after the value of A is determined, by employing a larger value of A/C, a value of C may be reduced, and thus the size of the walking beam can be further lowered. The above two conditions may reduce the size of the walking beam, and then the size of the whole machine is optimized.

A large pumping unit is large in masses of the walking beam and the donkey head, particularly, the donkey head; and at this time, by reducing the value of A, the rotational inertia of a reciprocating motion component of the pumping unit may be directly lowered. The rotational inertia is a natural property of a structural mass. The larger the rotational inertia is, the more the necessarily changed work done by a motion state is. Lowering the rotational inertia significantly improves both the requirement for a power plant of the pumping unit and the stability during operation.

Preferably, the first pivotal center is arranged on a walking beam middle seat; and the walking beam middle seat and peripheral bearing structures are all made of a material with yield strength greater than 300 MPa.

In order to compensate the negative effects brought by controlling the size, particularly at the first pivotal center, the requirement for the strength of the structure is higher; by employing the material with the yield strength greater than 300 MPa for the first pivotal center, the effect of increasing the whole stable degree of the beam pumping unit can be exerted.

It is understood that although the present disclosure defines that the material with higher yield strength is employed to improve the strength of the structure, it will be understood by those skilled in the art that after stress simulation, modification on the pivotal center of the pumping unit in the aspect of a mechanical model can also achieve the similar effect. The above two solve basically same technical problems, employ the measures belonging to common equivalent measures of those skilled in the art and also achieve basically same effect. Therefore, modification of the mechanical model should also belong to the technical features equivalent to the preferred technical features.

Preferably, the pumping unit further comprises a base. A power source is arranged on the base and is connected with a rotating arm to output a rotating power at the rotating center.

The power source is connected with the rotating arm and directly provides a rotating power to the rotating center. With such arrangement, the structure can be simplified to a certain degree, and the energy utilization rate is increased. Through a design of the base, the center of gravity of equipment can be lowered, and the stability is improved.

Preferably, the bracket comprises a first bracket and a second bracket; and the top ends of the first bracket and the second bracket are connected to each other, and the bottom ends of the first bracket and the second bracket are arranged at an interval and located on the front side and the rear side of the first pivotal center.

With the above arrangement, the stability of the whole pumping unit can be improved.

Preferably, the first bracket is arranged on the base; and the second bracket is fixedly connected with the base in a mode with an adjustable position.

Through adjustable-position fixed connection, the assembly difficulty of the components of the beam pumping unit may be lowered, and the mounting accuracy may be improved.

Preferably, the size of the walking beam is smaller than 12,000 mm.

By controlling the size of the walking beam within 12,000 mm, profiles are conveniently purchased, and transportation is convenient; and meanwhile, under the design of the above swinging angle, the super-long stroke, i.e. the stroke of 7,620 mm or above, can be realized.

Preferably, a vertical distance between the first pivotal center and a datum plane of the base is H, wherein 8,636 mm≤H≤11,830 mm.

With such arrangement, a necessary space can be provided for reciprocating motion of the donkey head; and meanwhile, more space can be reserved for operation of the drive rod and the rotating arm.

Further, a beam pumping unit is provided. The pumping unit has the stroke of 7,620 mm or above and a swinging angle satisfying: $58° < \delta \leq 72°$.

Through the above technical solution, the technical prejudices that the beam pumping unit cannot break through the stroke exceeding 7,620 mm and the swinging angle of the walking beam requires to be 58° or below in the prior art are overcome. By setting a large-swinging-angle walking beam with the swinging angle of the walking beam as $58° < \delta \leq 72°$, a longer motion distance may be provided at the tail end of the walking beam, and therefore, convenience is provided for achieving a long stroke. Also, under the condition of implementing the above super-long stroke beam pumping unit, the volume of the beam pumping unit cannot be increased significantly to result in the defect in applicability, so that the technical prejudices can be overcome, and the unexpected technical effects can further be achieved.

Preferably, a connecting line between a pivotal center on the walking beam tail seat and a pivotal center on the walking beam middle seat defines a straight line; the walking beam defines a second straight line; and an angle $\gamma$ is formed between the first straight line and the second straight line, and $3° \leq \gamma < 15°$.

As the pumping unit of the present disclosure has a super-long stroke, through the design of the angle $\gamma$, the walking beam may drive the donkey head to swing up and down relative to a plane comprising a pivotal center; and the walking beam and the donkey head are smaller in swinging distance in a space above the plane and longer in swinging distance in a space below the plane. Therefore, during working, the beam pumping unit may keep a low gravity center, and then balance and the stability of the whole pumping unit are kept.

Preferably, A is defined as a distance between the donkey head suspension point and the pivotal center on the walking beam middle seat; C is defined as a linear distance between the pivotal center on the walking beam tail seat and the pivotal center on the walking beam middle seat; and $2 < A/C \leq 2.5$.

In the design of the pumping unit of the present disclosure, in a case of a certain stroke S, A and the angle $\delta$ require to be adjusted to meet the stroke S. At this time, by employing a larger angle $\delta$, a value of A, the size of the walking beam and a rotational inertia may be all reduced; and after the value of A is determined, by employing a larger value of A/C, a value of C may be reduced, and thus the size of the walking beam can be further lowered. The above two conditions may reduce the size of the walking beam, and then the size of the whole machine is optimized.

A large pumping unit is large in masses of the walking beam and the donkey head, particularly, the donkey head; and at this time, by reducing the value of A, the rotational inertia of a reciprocating motion component of the pumping unit may be directly lowered. The rotational inertia is a natural property of a structural mass. The larger the rotational inertia is, the more the necessarily changed work done by a motion state is. Lowering the rotational inertia significantly improves both the requirement for a power plant of the pumping unit and the stability during operation.

Preferably, the walking beam middle seat and peripheral bearing structures are all made of a material with yield strength greater than 300 MPa.

In the super-long stroke beam pumping unit, due to increase in stroke but no significant increase in size, the stress situation of the whole structure is obviously different from that in the prior art, particularly at the pivotal center on the walking beam middle seat, and the requirement for the strength of the structure is higher; and by employing the material with the yield strength greater than 300 MPa for the pivotal center on the walking beam middle seat, the effect of increasing the whole stable degree of the beam pumping unit can be exerted. It is understood that although the present disclosure defines a mode of employing the material with higher yield strength to improve the strength of the structure, it may be understood by those skilled in the art that after stress simulation, modification on the pivotal center of the traditional pumping unit in the aspect of a mechanical model can also achieve the similar effect. The above two solve basically same technical problems, employ the measures belonging to common equivalent measures of those skilled in the art and also achieve basically same effect. Therefore, modification of the mechanical model should also belong to the technical features equivalent to the preferred technical features.

Preferably, the pumping unit further comprises a base. A power source is arranged on the base and is connected with a rotating arm to output a rotating power at the rotating center.

The power source is connected with the rotating arm and directly provides a rotating power to the rotating center. With such arrangement, the structure can be simplified to a certain degree. Through a design of the base, the center of gravity of equipment can be lowered, and the stability is improved.

Preferably, the pumping unit comprises a first bracket and a second bracket; and the top ends of the first bracket and the second bracket are connected to each other, and the bottom ends of the first bracket and the second bracket are arranged at an interval and located on the front side and the rear side of the pivotal center on the walking beam middle seat.

With the above arrangement, the stability of the whole pumping unit can be improved.

Preferably, the first bracket and the second bracket are arranged on the base; and the second bracket is fixedly connected with the base in a mode with an adjustable position.

Through adjustable-position fixed connection, the assembly difficulty of the components of the beam pumping unit may be lowered, and the mounting accuracy may be improved.

Preferably, the size of the walking beam is smaller than 12,000 mm.

By controlling the size of the walking beam within 12,000 mm, profiles are conveniently purchased, and transportation is convenient; and meanwhile, under the design of the above swinging angle, the super-long stroke, i.e. the stroke of 7,620 mm or above, can be realized.

Preferably, a vertical distance between the pivotal center on the walking beam middle seat and the datum plane of the base is H, and 8,636 mm≤H≤11,830 mm. With such arrangement, a necessary space is provided for reciprocating motion of the donkey head; and meanwhile, more space can be reserved for operation of the drive rod and the rotating arm.

Compared with the prior art, for the present disclosure, after constraining ranges of the swinging angle of the walking beam and an A/C ratio, a torque factor can be optimized, and the requirement for the power source can be lowered; in addition, the optimized pumping unit has smaller rotational inertia, so as to lower an energy consumed in a reciprocating motion; by setting a total length of the walking beam to be smaller than 12,000 mm, purchase of the profiles and transportation are facilitated; and with the above arrangement, the whole pumping unit is of a compact structure and has certain economy.

BRIEF DESCRIPTION OF THE DRAWINGS

To more clearly describe the technical solutions in the embodiments of the description or in the prior art, the drawings required to be used in the description of the embodiments or the prior art will be simply presented below. Apparently, the drawings in the following description are merely some embodiments recorded in the embodiments of the present description, and for those ordinary skilled in the art, other drawings can also be obtained according to these drawings.

REFERENCE NUMERALS

Figure 1:
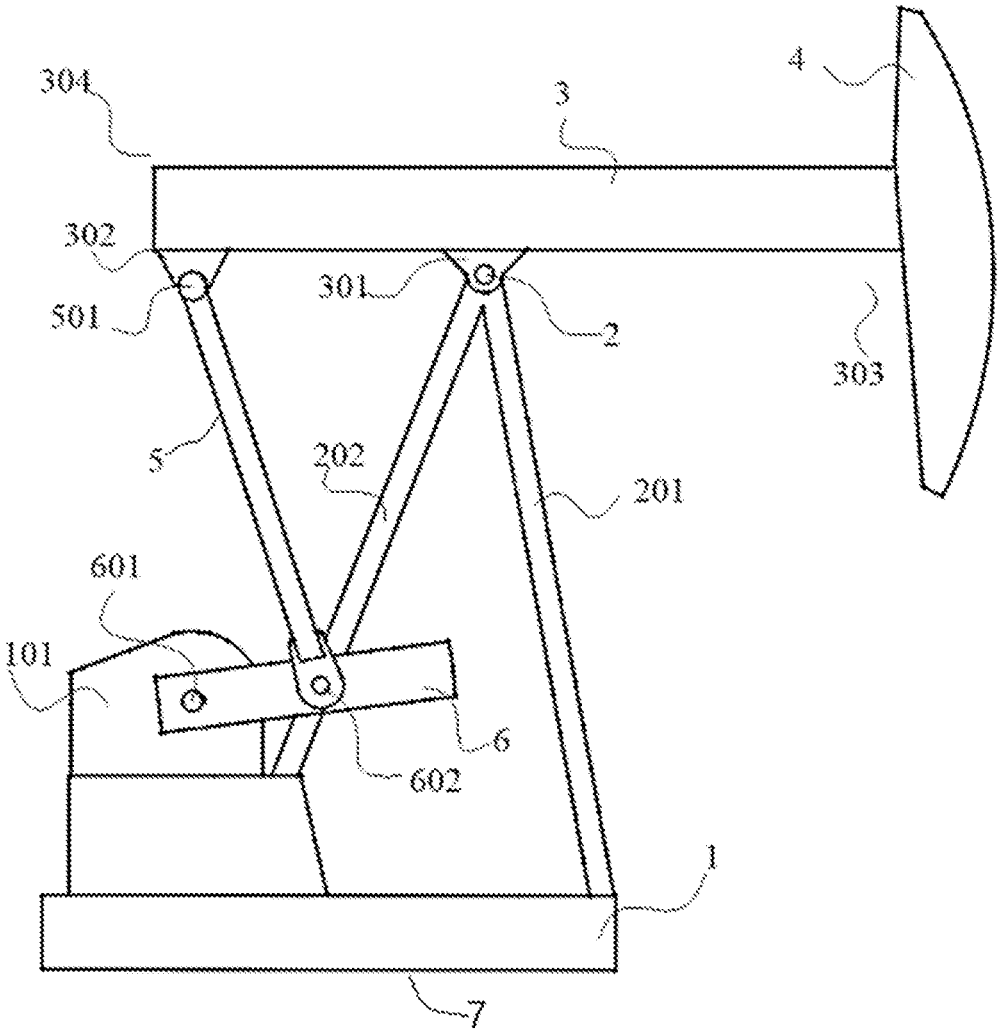
FIG. 1 is a structure diagram of a pumping unit according to an embodiment of the present disclosure.

1. base; 101. power source; 2. first pivotal center; 201. first bracket; 202. second bracket; 3. walking beam; 301. walking beam middle seat; 302. walking beam tail seat; 303. first end; 304. second end; 4. donkey head; 5. drive rod; 501. third pivotal center; 6. rotating arm; 601. rotating center; 602. second pivotal center; 7. datum plane of base.

DETAILED DESCRIPTION OF THE EMBODIMENTS

In order to make objectives, technical solutions, and advantages of embodiments of this application clearer, the technical solutions in the embodiments of this application are described clearly and completely in the following with reference to accompanying drawings in the embodiments of this application. Apparently, the described embodiments are only part rather than all of the embodiments of this application. Based on the embodiments of the present application, all the other embodiments obtained by that of ordinary skill in the art without inventive effort are within the scope of the present application.

In description of the embodiments of the present disclosure, it should be noted that unless otherwise specifically stated and defined, the term "connecting" should be understood broadly, for example, may be fixed connection, may also be detachable connection; or integral connection may be mechanical connection, may also be electric connection; and may be direct connection, may also be indirect connection through an intermediary. The specific meanings of the above term in the present disclosure may be understood according to the specific situations to those of ordinary skill in the art.

The terms "top", "bottom", "above", "lower" and "on" used in description herein refer to relative positions relative to components of a device, for example, the relative position of liners on the top and at the bottom in the device. It is understood that the devices are multifunctional without relationship with orientation of the devices in the space.

For ease of understanding the embodiments of this application, further explanation and description will be made by the specific embodiments in conjunction with the accompanying drawings, and the embodiments do not to limit the embodiments of this application.

The beam pumping unit is one of mainly used pumping units at present, in which a four-connecting-rod mechanism is mainly formed by a donkey head, a walking beam, a drive rod and a rotating arm. The beam pumping unit comprises components such as the walking beam, a bracket, the drive rod, the rotating arm and a base; the walking beam is located above a pumping unit and is supported by the bracket; the bracket is connected with the middle part of the walking beam; and the donkey head is arranged at one end of the walking beam, and the other end of the walking beam is pivotally connected with the upper end of the drive rod. When the beam pumping unit runs, the connecting position of the bracket and the walking beam serves as a fulcrum of the walking beam, and the walking beam swings up and down around the fulcrum. The lower end of the drive rod is connected with the rotating arm, the rotating arm has the rotating center, and the rotating center is connected with a power source. When the beam pumping unit works, the power source drives the rotating arm to make a uniform circular motion; the rotating arm drives the walking beam through the drive rod to swing up and down with a center bearing on the bracket as a fulcrum; then a donkey head suspension point at the front end of the walking beam is driven to be connected with a sucker rod and an oil pump plunger to make an up-down reciprocating rectilinear motion; and finally, mechanical oil extraction is achieved.

A design method for the beam pumping unit comprises: firstly, determining a basic size of the beam pumping unit according to the actual situation and an application scenario; establishing an expression about a torque factor of a donkey head suspension point stroke according to a size range; and conducting optimization with the maximal torque factor as a target function. Parameters for affecting the torque factors comprise distances between various components, for example, a distance between the donkey head suspension point and a fulcrum on the walking beam, a distance between the rotating center and the lower end of the drive rod, a distance between the lower end of the drive rod and one end, far away from the donkey head, of the walking beam, a distance between the rotating center and the fulcrum of the walking beam, a distance between the fulcrum of the walking beam and one end, far away from the donkey head, of the walking beam, a vertical distance between the fulcrum and the base and a vertical distance between the rotating center and the base. A constraint equation is constructed by the parameters through a maximal stroke, an included angle between the walking beam and a horizontal line, a swinging angle of the walking beam, an extreme positional included angle, a driving angle, an initial angle, an included angle between a vertical direction above the rotating center and a direction of a connecting line between the lower end of the drive rod and the rotating center, a ratio of a front arm to a rear arm of the walking beam with the fulcrum as a center and the like; the above influencing parameters all have selection ranges including various options; hundreds of torque factors would be obtained through permutation and combination of various selection ranges; and therefore, the difficulty of an optimal solution may be foreseen.

In the prior art, there is a certain range for selection of the above parameters. In *Design And Calculation for Beam Pumping Unit* written by Jianjun Zhang, Xiangqi Li and Huining Shi and published by Petroleum Industry Press in 2005, in specifications in the design for the pumping unit, the swinging angle of the walking beam is limited as $44° \leq \delta \leq 58°$, and a ratio range of the front arm to the rear arm of the walking beam is $1 \leq A/C \leq 2$. In general, the pumping unit with the stroke exceeding 4500 mm has already appeared very heavy and can employ other transmission forms generally; specifications and rated values of the pumping unit are given in Table B.1 in Appendix B in Design Standard For American Pumping Unit API SPECIFICATION 11E (19th Edition), wherein a maximum stroke limit is 7,620 mm (300 in). Therefore, in a generic sense, it is considered that the beam pumping unit is not suitable for the working conditions with the strokes of 7,620 mm or above.

The present disclosure has the main inventive concept that through a design of breaking through the technical prejudices of ranges of a stroke limit, the swinging angle of the walking beam and the like of the beam pumping unit in the prior art, a larger stroke distance which cannot be achieved by a long stroke beam pumping unit in the prior art can be achieved while the pumping unit is not changed in the size significantly and keeps stable operation; and therefore, the petroleum gathering efficiency is improved. In addition to this, further through modifications on other related structures, one or more of functions of improvement in strength, improvement in stability and the like is further achieved.

Embodiment 1

Figure 2:
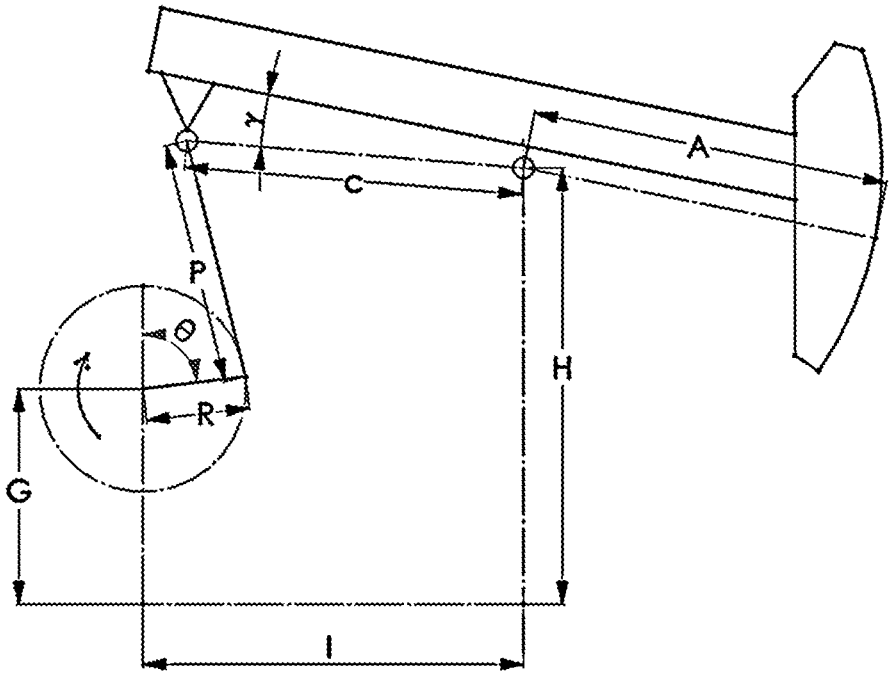
FIG. 2 is a structure principle diagram of a pumping unit according to an embodiment of the present disclosure.

This embodiment provides a beam pumping unit, as shown in FIGS. 1-2.

The beam pumping unit comprises a base 1, a bracket, a walking beam 3, a rotating arm 6 and a drive rod 5.

The base 1 is located below the pumping unit, is internally provided with a power source 101 and provides a necessary power for operation of the pumping unit.

The bracket comprises a first bracket 201 and a second bracket 202; the bottom end of the first bracket 201 and the bottom end of the second bracket 202 are both connected with the upper part of the base 1; the top end of the first bracket 201 is connected with the top end of the second bracket 202; a first pivotal center 2 is arranged at the connecting part of the top ends of the first bracket 201 and the second bracket 202. The bottom ends of the first bracket 201 and the second bracket 202 are arranged at an interval and are located on the front side and the rear side of the first pivotal center 2 respectively. The base 1, the first bracket 201 and the second bracket 202 substantially form a triangular shape, so as to provide certain stability of the pumping unit; and thus operation of the pumping unit can be effectively guaranteed. Further, the second bracket 202 is fixedly connected with the base 1 in a mode of adjustable position.

The walking beam 3 has a total length smaller than 12,000 mm and is arranged above the bracket; a walking beam middle seat 301 is arranged at the middle part of the walking beam 3 and forms a first pivotal connection having the first pivotal center 2 with the first bracket 201 and the second bracket 202 together. The first bracket 201, the second bracket 202 and the walking beam middle seat 301 can conduct pivotal motion with the first pivotal center 2 as a center. By controlling the size of the walking beam within 12,000 mm, profiles are conveniently purchased, and transportation is convenient; and meanwhile, under the design of the above swinging angle, a super-long stroke, i.e. the stroke of 7,620 mm or above, can be realized.

The first pivotal center 2 serves as a fulcrum for supporting the walking beam 3 to conduct up-down motion; the fulcrum is arranged on the walking beam middle seat 301; and the walking beam middle seat 301 and peripheral bearing structures are made of a material with yield strength greater than 300 MPa. When stresses endured by the walking beam middle seat 301 and the peripheral bearing structures exceed the yield strength of the material, the walking beam middle seat 301 and the peripheral bearing structures would be subjected to permanent deformations.

In the super-long stroke beam pumping unit, due to increase in stroke but no significant increase in size, the stress situation of the whole structure is obviously different from that in the prior art, particularly at the first pivotal center, and the requirement for the strength of the structure is higher; and by employing the material with the yield strength greater than 300 MPa for the first pivotal center, the effect of increasing the whole stable degree of the beam pumping unit can be exerted. It is understood that although the present disclosure defines a mode of employing the material with higher yield strength to improve the strength of the structure, it may be understood by those skilled in the art that after stress simulation, modification on the pivotal center of the traditional pumping unit in the aspect of a mechanical model can also achieve the similar effect. The above two solve basically same technical problems, employ the measures belonging to common equivalent measures of those skilled in the art and also achieve basically same effect. Therefore, modification of the mechanical model should also belong to the technical features equivalent to the preferred technical features. Through the above settings for the yield strength of the material for the walking beam middle seat and the peripheral bearing structures, supporting is provided for the walking beam middle seat, so as to guarantee that the walking beam can stably conduct reciprocating motion.

A vertical distance from the first pivotal center 2 to a datum plane 7 of the base 1 is H and satisfies: 8,636 mm≤H≤11,830 mm; and a range design for H can provide a necessary space for a reciprocating motion of the donkey head 4 and can reserve more space for operation of the drive rod 5 and the rotating arm 6 at the same time.

The walking beam 3 is divided into the front side and the rear side with the first pivotal center 2 as a boundary and comprises a first end 303 located on the front side and a second end 304 located on the rear side. The first end 303 is provided with the donkey head 4; and the donkey head 4 is provided with a beam hanger. When the pumping unit works, the donkey head 4 pulls the beam hanger to drive a sucker rod to move up and down; an included angle formed between a top dead center of movement of the donkey head 4 and a lower dead center of movement of the donkey head 4 is that a swinging angle δ of the walking beam 3 satisfies: 58°<δ≤72. A piston in an oil pump at the bottom of a well is driven by an up-down motion of the donkey head 4; the stroke of the donkey head 4 is 7,620 mm or above and is a distance for an up-down reciprocating motion of a suspension point of the pumping unit; and a walking beam tail seat 302 is arranged at the second end 304. Further, a distance between the donkey head suspension point and the first pivotal center 2 is A.

Through the above technical solution, by setting the swinging angle of the walking beam as: 58°<δ≤72, the convenience may be provided as follows: a large-swinging-angle walking beam may provide a longer motion distance at the tail end of the walking beam, and thus convenience is provided for implementing a long stroke; with setting the above swinging angle in the design of the beam pumping unit, particularly the beam pumping unit with the stroke of 7,620 mm or above, for the corresponding pumping unit structure designed by a corresponding method, the size of the pumping unit is not changed significantly, and stable swinging of the donkey head can also be provided. Compared with consideration that the swinging angle of the beam pumping unit can be at 58° or below only in a traditional design handbook, the technical prejudices are overcome, and the unexpected technical effect can be achieved.

The upper end of the drive rod 5 forms a third pivotal connection having a third pivotal center 501 with the walking beam tail seat 302, the third pivotal center 501 is arranged on the walking beam tail seat 302, and a linear distance between the third pivotal center 501 and the first pivotal center 2 is C; and the lower end of the drive rod 5 is connected with the rotating arm 6 to form a second pivotal connection having a second pivotal center 602.

A ratio range of the distance between the donkey head suspension point and the first pivotal center 2 to the linear distance between the third pivotal center 501 and the first pivotal center 2 is: 2<A/C≤2.5. The above design also overcomes the technical prejudice that the design on A/C requires to be smaller than or equal to 2 in a textbook. In the beam pumping unit with the stroke greater than 300 feet, by setting a value of the above A/C, rotational inertia can be reduced to a considerable extent when the power source is arranged at the rear end of the walking beam to drive the walking beam to rotate; and then energy consumption in the reciprocating motion is reduced.

The third pivotal center 501 and the first pivotal center 2 define a first straight line; and the walking beam 3 defines a second straight line. The first straight line is a straight line determined by two points which are the third pivotal center 501 and the first pivotal center 2; and the second straight line is a medial axis in an extending direction of the walking beam 3. An angle γ is formed by intersection of the first straight line and the second straight line and falls in a range as: 3°≤γ<15°.

As the pumping unit of the present disclosure has a super-long stroke, through the design of the angle γ, the walking beam 3 may drive the donkey head 4 to swing up and down relative to a plane comprising a pivotal center; and the walking beam 3 and the donkey head 4 are smaller in swinging in a space above the plane and longer in swinging distance in a space below the plane. Therefore, during working, the beam pumping unit may keep a low gravity center, and then balance and the stability of the whole pumping unit are kept.

The rotating arm 6 is arranged behind and below the first pivotal center 2 and is connected with the power source 101. Further, the rotating arm 6 has a rotating center 601 connected with the power source 101; the position, at which the rotating center 601 is located, is a first position and is located at one end of the rotating arm 6; the rotating arm 6 is provided with a second position; and a distance between the second position and the first position is R. When the rotating arm 6 rotates, the power source 101 outputs a rotating force at the rotating center 601 to drive the rotating arm 6 to make a circular motion; and the second position would make a circular motion with the first position as a center of a circle by a radius of R.

The power source 101 is connected with the rotating arm 6 and directly provides a rotating power to the rotating center 601. With such arrangement, the structure can be simplified to a certain degree, and the energy utilization rate is increased. Through a design of the base 1, the center of gravity of the pumping unit can be lowered, and the stability is improved.

Further, the second position is pivotally connected with the lower end of the drive rod 5; the center of this pivotal connection is the second pivotal center 602; when the rotating arm 6 makes a rotating motion, the second pivotal center 602 makes the circular motion around the rotating center 601 with a rotating angle θ; and then the drive rod 5 is driven to pull the second end 304 of the walking beam 3, which results in that the donkey head 4 would swing at a preset magnitude with an angle δ, wherein δ is the swinging angle between the top dead center and the lower dead center of the walking beam 3. The rotating arm 6 drives the walking beam 3 to swing at the preset magnitude to drive the donkey head 4 to conduct the up-down reciprocating motion, and then the sucker rod is driven to pump petroleum.

This embodiment provides a pumping unit with a super-long stroke exceeding 7,620 mm. With the pumping unit, petroleum at a certain depth which cannot be reached by a universal stroke can be gathered, and the economic benefit is effectively increased. A total length of the walking beam 3 is smaller than 12,000 mm while the pumping unit has the super-long stroke, and the total length of the walking beam 3 decides a compact structure of the whole pumping unit; so that purchase of profiles and transportation are facilitated, and the pumping unit has a certain economic significance. In addition, in this embodiment, by setting parameters, including a material of the walking beam 3, a ratio of a front arm to a rear arm of the walking beam 3, a walking beam swinging angle and an included angle between the first straight line and the second straight line, of the pumping unit, the reliability of the pumping unit is further improved to a certain degree.

Embodiment 2

This embodiment provides a design method for a pumping unit. By setting the method, the beam pumping unit with a stroke greater than 7,620 mm, for example, including, but not limited to, one or more kinds of pumping units limited in embodiment 1.

In this embodiment, forms implemented by the design method includes, but not limited to: the design solution is expressed by giving a design drawing, passing on a construction method, guiding construction and employing various media forms. In addition, in this specific implementation, the sequence of executing steps of the design method is not limited.

In consideration of different application scenarios and traffic transportation conditions, the basic size of the pumping unit is determined according to a design target.

Figure 3:
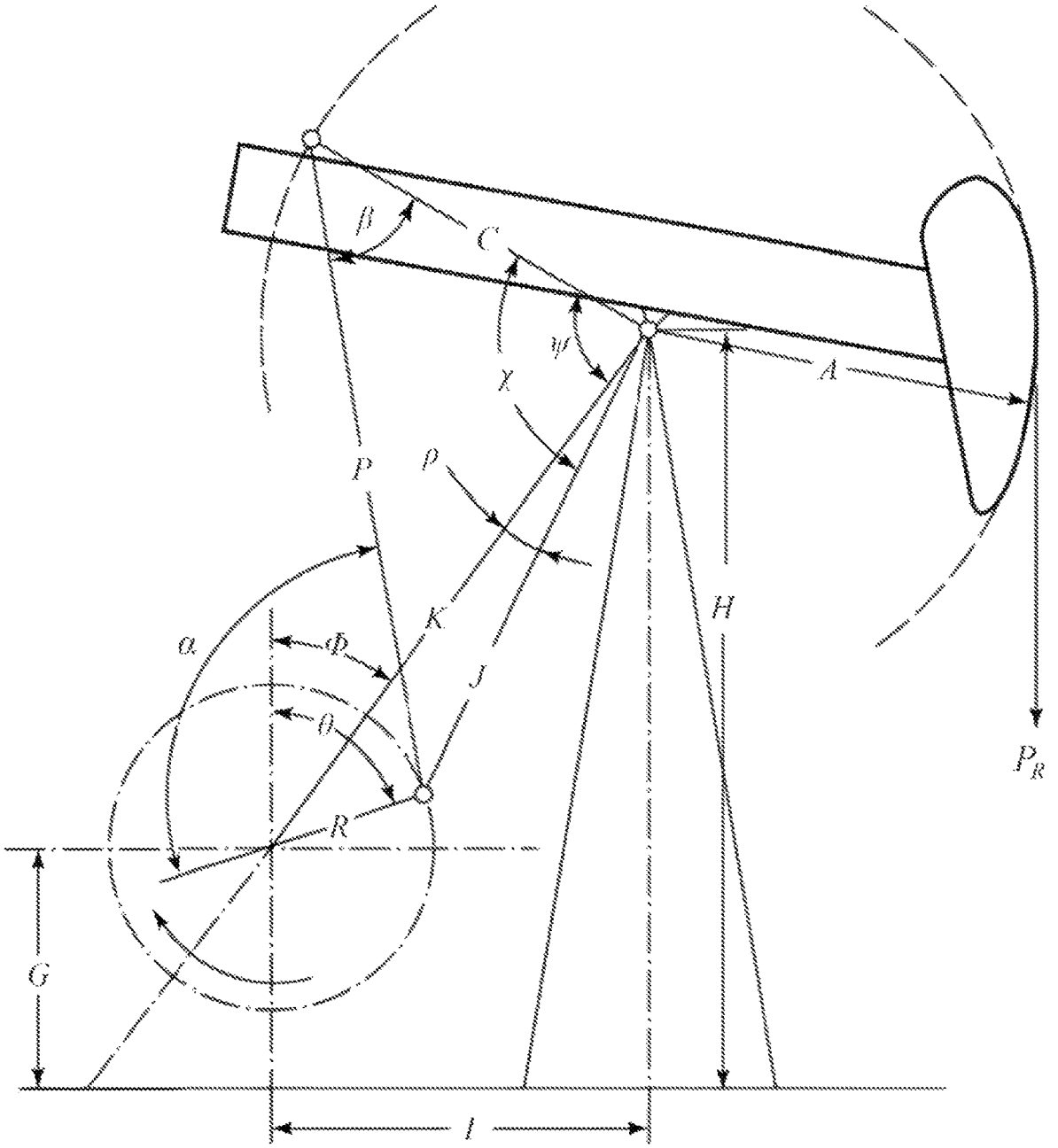
FIG. 3 is another structure principle diagram of a pumping unit according to an embodiment of the present disclosure.
Figure 4:
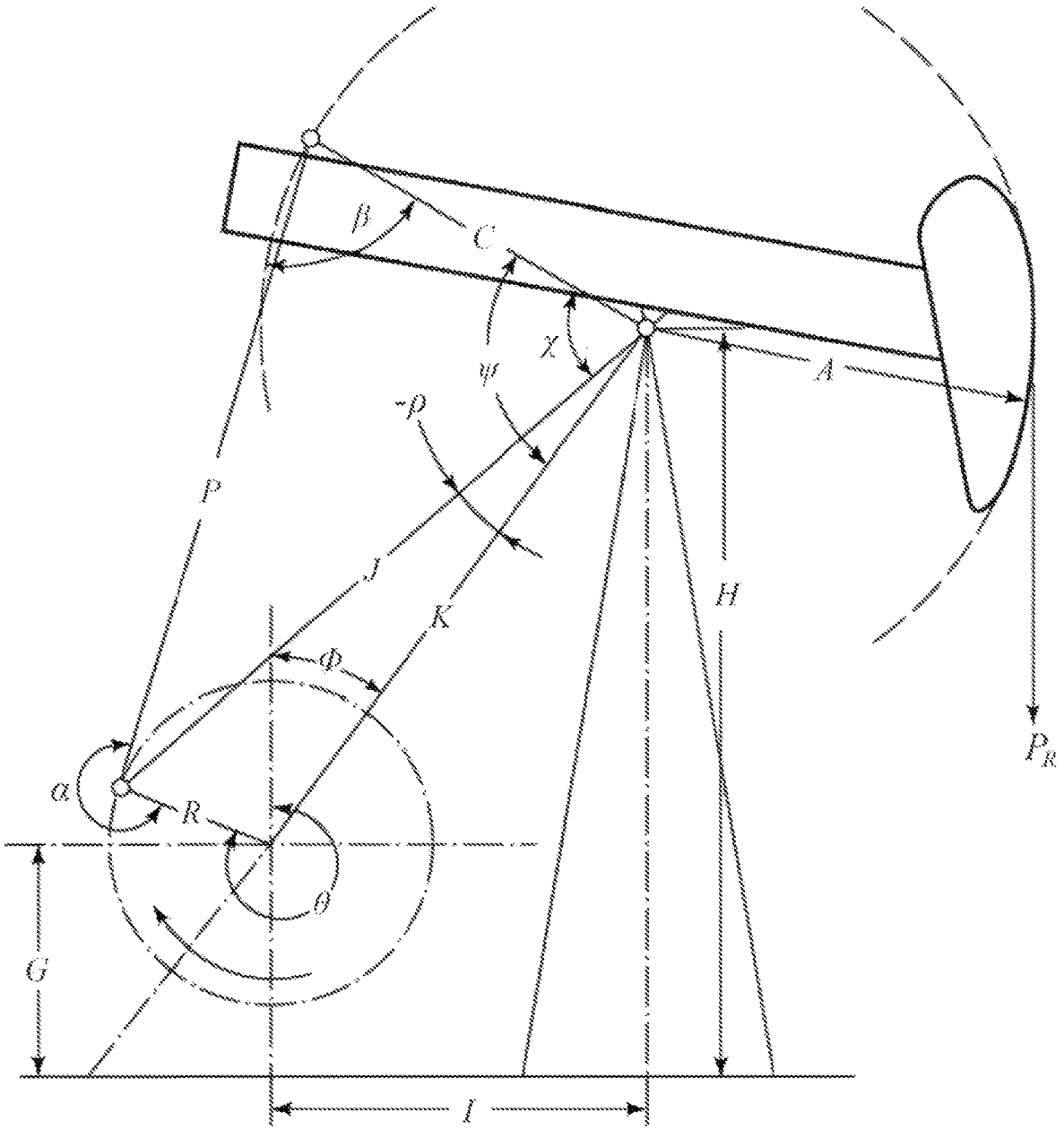
FIG. 4 is yet another structure principle diagram of a pumping unit according to an embodiment of the present disclosure.

Referring to FIGS. 2-4, parameters of the size comprise: A, R, P, C, K, I, H and G, wherein A is a distance between a donkey head suspension point and a first pivotal center 2; R is a distance from a second pivotal center 602 to a rotating center 601; P is a distance between a second pivotal center 602 and a third pivotal center 501; C is a linear distance between the third pivotal center 501 and the first pivotal center 2; K is a distance from the rotating center 601 to the first pivotal center 2; I is a horizontal distance between the rotating center 601 and the first pivotal center 2; H is a vertical distance from the first pivotal center 2 to a datum plane 7 of a base; and G is a vertical distance from the rotating center 601 to the datum plane 7 of the base.

Through the above parameters, torque factors of the pumping unit when the rotating arm at different angles θ, being represented as:

$$TF = \frac{AR}{C}\frac{\sin\alpha}{\sin\beta}$$

wherein:

$$\alpha = \beta + \psi - (\theta - \phi)$$

$$\beta = \cos^{-1}\left(\frac{C^2 + P^2 - K^2 - R^2 + 2RK\cos(\theta - \phi)}{2CP}\right),$$

$$\phi = \tan^{-1}\left(\frac{I}{H - G}\right)$$

$$\psi = \chi - \rho$$

$$\rho = \sin^{-1}\left(\frac{R\sin(\theta - \phi)}{J}\right)$$

$$\chi = \cos^{-1}\left(\frac{C^2 + J^2 - P^2}{2CJ}\right)$$

$$J = \sqrt{C^2 + P^2 - (2CP\cos\beta)}$$

J is a distance between the first pivotal center 2 and the second pivotal center 602; α is an included angle between a direction of R and a direction of P; β is an included angle between a direction of C and the direction of P; ψ is an included angle between the direction of C and a direction of K; θ is a rotating angle of a rotating arm 6, representing an included angle between a vertical direction above the rotating center 601 and the direction of R; ∅ is an included angle between the vertical direction above the rotating center 601 and the direction of K; χ is an included angle between a direction of J and the direction of C; and ρ is an included angle between the direction of K and the direction of J.

From the above expression, the torque factors are functions related to A, R, C, P, H, I, G and θ. A maximal torque factor $\overline{TF}_{max}$ is taken as a target function. It is relatively difficult to solve the maximal torque factor directly through the expression; so that a calculation point is taken each 5° in a range of the rotating angle θ of the rotating arm 6 from 0° to 360° [$\theta_i$=(i−1)5°, i=1, 2, 3, . . . , 73], and then the target function may be represented as:

$$\overline{TF}_{max} = \max[\overline{TF}_i, i = 1,2,3, \ldots, 73]$$

a workload of calculating the target function through the above formula is large, and it may be obtained from a change rule of the torque factors that the maximal torque factor occurs at about θ=75°. So, it may be considered that $\overline{TF}_{max} \approx \overline{TF}|_{\theta=75°}$, and thus the target function is simplified again to obtain:

$$\overline{TF}_{max} = \overline{TF}|_{\theta=75°}$$

after the target function of the pumping unit is constructed, a constraint condition requires to be set for design variables affecting the target function to limit values of the design variables.

From the above mentioned, $\overline{TF}_{max} = f_{(A, R, C, P, H, I, G, \theta)}$. In other words, the design variables affecting the target function comprise A, R, C, P, H, I, G and θ, and then $\overline{TF}_{max}$=f(θ=75°) can be determined by assigning specific values of A, R, C, P, H, I and G. The values of A, R, C, P, H, I and G decide the performance of the pumping unit and also the structure size and affect the strength of each specific member. In a reality design, it more requires to make a comprehensive consideration from the aspects of material purchase, processing and manufacturing, transportation, universality of accessories, the performance of the pumping unit and the like, and a final design solution is determined.

Values of several parameters and combination of the parameters both cause obvious effect on the performance of the pumping unit. If possible values of all the parameters are verified in a mode of permutation and combination only, the number of solutions obtained after permutation and combination is incredibly large, so that the solutions cannot be screened and verified one by one.

To avoid experiments and verification one by one, based on key design parameters, including existence conditions for a maximal stroke, the swinging angle of the walking beam, an initial angle and the second pivotal center 602, obtained under the working principle and empirical summary for the beam pumping unit, a ratio of the front arm to the rear arm of the walking beam 3 with the first pivotal center 2 as the boundary and the like, and based on constraints to these key parameters, it may help a designer find a suitable solution to a certain degree.

However, designing the pumping unit based on these parameter constraints also means that a parameter range based on a general experience and guidance in the textbook cannot be broken through; or otherwise, severe defects related to the performance of the pumping unit can be caused. These parameters comprise: the swinging angle δ of the walking beam below 58° and the like; wherein the swinging angle δ of the walking beam is an included angle between a position when the walking beam 3 reaches a top dead center and a position when the walking beam 3 reaches a lower dead center. In addition, in the prior art and a custom design guidance, there is further a technical prejudice that the stroke of the pumping unit does not exceed 6,000 mm generally.

For example, in *Design And Calculation for Beam Pumping Unit* written by Jianjun Zhang, Xiangqi Li and Huining Shi and published by Petroleum Industry Press in 2005, the swinging angle of the walking beam is limited as $44° \leq \delta \leq 58°$, and a ratio range of the front arm to the rear arm of the walking beam 3, taking the first pivotal center 2 as the boundary, is $1 \leq A/C \leq 2$.

In general, the pumping unit with the stroke exceeding 4500 mm has already appeared very heavy and can employ other transmission forms generally; specifications and rated values of the pumping unit are given in Table B.1 in Appendix B in *American Design Standard For Pumping Unit* API SPECIFICATION 11E (19th Edition), wherein a maximum stroke limit is 7,620 mm (300 in).

Exemplarily, for a specific stroke S, a relationship between the swinging angle δ of the walking beam and the A value may be represented as $$A = \frac{180S}{\delta\pi}.$$

If a smaller swinging angle requires to be designed, a larger A value is required.

The ratio A/C of the front arm to the rear arm of the walking beam decides a ratio of a load at a well mouth to a load at the walking beam tail seat 302; the walking beam tail seat 302 is arranged at one end, far away from the donkey head 4, of the first pivotal center 2 on the walking beam 3; and if A/C is reduced, a contour of the whole machine becomes larger, particularly, the size of a profile of the walking beam 3 is increased, and then control is also required in design.

In a technical solution of this embodiment, the constraint conditions of the target function are as follows: the stroke is greater than 7,620 mm; the swinging angle of the walking beam δ is that $58° < \delta \leq 72°$; the size of the walking beam is smaller than 12,000 mm; and a range of H is that 8,636 mm≤H≤11,830 mm.

Through the above technical solution, by setting the swinging angle of the walking beam as: $58° < \delta \leq 72$, the convenience may be provided as follows: firstly, a large-swinging-angle walking beam may provide a longer motion distance at the tail end of the walking beam, and thus convenience is provided for implementing a long stroke; with setting the above swinging angle in the design of the beam pumping unit, particularly the beam pumping unit with the stroke of 7,620 mm or above, for the corresponding pumping unit structure designed by a corresponding method, the size of the pumping unit is not changed significantly, and stable swinging of the donkey head can also be provided. Compared with consideration that the swinging angle of the beam pumping unit can be at 58° or below only in the traditional design handbook, the technical prejudices are overcome, and the unexpected technical effect can be achieved.

Similarly, the above design also overcomes the technical prejudice that the design on A/C requires to be smaller than or equal to 2 in the textbook. In the beam pumping unit with the stroke greater than 300 feet, by setting a value of the above A/C, rotational inertia can be reduced to a considerable extent when the power source is arranged at the rear end of the walking beam to drive the walking beam to rotate; and then energy consumption in the reciprocating motion is reduced.

In addition, the third pivotal center 501 and the first pivotal center 2 define a first straight line; and the walking beam 3 defines a second straight line. The first straight line is a straight line determined by two points which are the third pivotal center 501 and the first pivotal center 2; and the second straight line is a medial axis in an extending direction of the walking beam 3. An angle γ is formed by intersection of the first straight line and the second straight line and falls in a range as: $3° \leq \gamma < 15°$.

As the pumping unit of the present disclosure has a super-long stroke, through the design of the angle γ, the walking beam 3 may drive the donkey head 4 to swing up and down relative to a plane comprising a pivotal center; and the walking beam 3 and the donkey head 4 are smaller in swinging in a space above the plane and longer in swinging distance in a space below the plane. Therefore, during working, the beam pumping unit may keep a low gravity center, and then balance and the stability of the whole pumping unit are kept.

The requirement for a torque of a speed reducer is lowered; the pumping unit has smaller rotational inertia to consume smaller energy in the reciprocating motion; a total length of the walking beam 3 of the pumping unit is smaller than 12,000 mm, so that profile purchase and transportation are facilitated; and the size decides a compact structure of the whole pumping unit, and then the price performance ratio of the pumping unit is increased. As the set parameter range has obvious advantages in the design of an extra-large-stroke beam pumping unit, the pumping unit of the present disclosure has higher reliability and comprehensive efficiency.

To sum up, this embodiment comprises the following design method for the beam pumping unit:

A1. A design method for a beam pumping unit, comprising:

setting a stroke to be greater than or equal to 7,620 mm;

setting a value of a swinging angle of a walking beam, wherein the value is greater than 58° and smaller than or equal to 72°.

A2. The design method for the beam pumping unit according to claim A1, wherein a connecting line between a pivotal center on a walking beam tail seat and a pivotal center on a walking beam middle seat defines a first straight line; the walking beam defines a second straight line;

an angle $\gamma$ is formed between the first straight line and the second straight line, and $3° \leq \gamma < 15°$.

A3. The design method for the beam pumping unit according to claim A1 or A2, wherein A is defined as a distance between a donkey head suspension point and the pivotal center on the walking beam middle seat; C is defined as a linear distance between the pivotal center on the walking beam tail seat and the pivotal center on the walking beam middle seat; and $2 < A/C \leq 2.5$.

A4. The design method for the beam pumping unit according to claim A1, wherein the walking beam middle seat and peripheral bearing structures are all made of a material with yield strength greater than 300 MPa.

A5. The design method for the beam pumping unit according to claim A1, wherein the pumping unit further comprises a base;

a power source is arranged on the base and is connected with a rotating arm to output a rotating power at the rotating center.

A6. The design method for the beam pumping unit according to claim A5, wherein the pumping unit comprises a first bracket and a second bracket; and the top ends of the first bracket and the second bracket are connected to each other, and the bottom ends of the first bracket and the second bracket are arranged at an interval and located on the front side and the rear side of the pivotal center on the walking beam middle seat respectively.

A7. The design method for the beam pumping unit according to claim A6, wherein the first bracket and the second bracket are arranged on the base; and the second bracket is fixedly connected with the base in a mode with an adjustable position.

A8. The design method for the beam pumping unit according to any one of claims A4, A5 and A6, wherein the size of the walking beam is smaller than 12,000 mm.

A9. The design method for the beam pumping unit according to claim A8, wherein a vertical distance between the pivotal center on the walking beam middle seat and a datum plane of the base is H, and $8{,}636\ \text{mm} \leq H \leq 11{,}830\ \text{mm}$.

The above specific implementations make further description of the objectives, technical solutions and beneficial effects of this application in detail. It should be understood that the foregoing is only specific implementations of this application and is not intended to be limiting of the scope of this application, and any modifications, equivalent substitutions, improvements and the like within the spirit and principles of the present application are intended to be embraced by the protection range of the present application.

What is claimed is:

1. A beam pumping unit, comprising:

a set of beams;

a walking beam arranged above the set of beams, wherein a middle part of the walking beam forms a first pivotal connection having a first pivotal center with the set of beams, a first portion is extended over a first side of the first pivotal center, a second portion is extended over a second side of the first pivotal center, a donkey head is mounted at the first portion, a walking beam tail seat is mounted at the second portion, and a distance from a donkey head suspension point to the first pivotal center is A;

a rotating arm arranged behind and below the first pivotal center, wherein the rotating arm has a first position formed as a rotating center and a second position revolving around the rotating center by a radius R, wherein the rotating arm is vertically oriented and directly coupled to a power source such that the power source outputs torque directly to the rotating arm without an intermediate transmission;

a drive rod, wherein a lower part of the drive rod and the second position form a second pivotal connection having a second pivotal center, and an upper part of the drive rod and the walking beam tail seat form a third pivotal connection having a third pivotal center, wherein the rotating arm is configured to pivot about a vertical axis through an angular displacement to drive the drive rod in a substantially vertical plane;

a straight line distance between the third pivotal center and the first pivotal center is C;

the second pivotal center makes a circular motion around the rotating center at a rotating angle $\theta$ to drive the walking beam to swing at a preset magnitude of angle $\delta$, and then the donkey head is driven to conduct up-down reciprocating motion;

the third pivotal center is set higher than the rotating center; wherein a stroke of the beam pumping unit is greater than 7,620 mm; and $$58° < \delta \leq 72°.$$

2. The beam pumping unit according to claim 1, wherein the third pivotal center and the first pivotal center define a first straight line;

the walking beam defines a second straight line;

an angle $\gamma$ is formed between the first straight line and the second straight line; and $$3° \leq \gamma < 15°.$$

3. The beam pumping unit according to claim 1, wherein $2 < A/C \leq 2.5$.

4. The beam pumping unit according to claim 1, wherein the first pivotal center is arranged on a walking beam middle seat; and the walking beam middle seat is made of a material with a yield strength greater than 300 MPa.

5. The beam pumping unit according to claim 1, further comprising a base, wherein the power source is arranged on the base and is connected with the rotating arm to output a rotating power at the rotating center.

6. The beam pumping unit according to claim 5, wherein the set of beams comprises a first beam and a second beam; and top ends of the first beam and the second beam are connected to each other, and bottom ends of the first beam and the second beam are arranged at an interval and located on the front side and the rear side of the first pivotal center.

7. The beam pumping unit according to claim 6, wherein the first beam is arranged on the base; and the second beam is fixedly connected with the base in a way that a position of the second beam is adjustable.

8. The beam pumping unit according to claim 6, wherein a size of the walking beam along the distance from the donkey head suspension point to the first pivotal center is less than 12,000 mm.

9. The beam pumping unit according to claim 8, wherein a vertical distance between the first pivotal center and an upper surface of a datum plane of the base is H, and 8,636 mm≤H≤11,830 mm.

* * * * *